United States Patent [19]

Peppard

[11] 4,290,287

[45] Sep. 22, 1981

[54] DOUBLE CHANGEABLE KEY LOCK FOR SAFE DEPOSIT BOXES AND THE LIKE

[75] Inventor: James P. Peppard, Nicholasville, Ky.

[73] Assignee: Sargent & Greenleaf, Inc., Nicholasville, Ky.

[21] Appl. No.: 71,352

[22] Filed: Aug. 28, 1979

[51] Int. Cl.[3] ..... E05B 25/00

[52] U.S. Cl. ..... 70/355; 70/383

[58] Field of Search ..... 70/337, 339, 340, 341, 70/342, 343, 353, 354, 355, 382, 383, 384

[56] References Cited

U.S. PATENT DOCUMENTS 3,978,700 9/1976 Glass ..... 70/339

FOREIGN PATENT DOCUMENTS 15962 of 1886 United Kingdom ..... 70/383

*Primary Examiner*—Robert L. Wolfe

*Attorney, Agent, or Firm*—Mason, Fenwick & Lawrence

[57] ABSTRACT

A changeable multiple key lock for safe deposit boxes and the like, including a locking bolt slidably movable in a lock case and having a pair of longitudinally spaced fence members, two stacks of peripherally gated tumbler wheels rotatably supported in the path of unlocking movement of the fence members having gating recesses to receive the fence members to permit bolt retraction to unlocking position, and two sets of key operable pivoted sector levers having gear teeth couplings with the two stacks of tumbler wheels to be operated by a guard key and a renter key. The two sets of sector levers are pivotally mounted eccentrically on posts which are rotatable to positions decoupling the levers from their associated tumbler wheels by a change key to free the sector levers to assume new positions for a new renter's key or a new guard key.

12 Claims, 8 Drawing Figures

DOUBLE CHANGEABLE KEY LOCK FOR SAFE DEPOSIT BOXES AND THE LIKE

BACKGROUND AND OBJECTS OF THE INVENTION

The present invention relates in general to key locks, and more particularly to key locks for safe deposit boxes and the like, wherein both a guard key or "prep" key and a renter's key having a proper configuration on the key bit must be inserted into the lock and rotated to effect retraction of the bolt, and wherein the lock is capable of being changed in the field for different guard or prep keys and for different renter keys.

It will be appreciated that safe deposit boxes in bank vaults and similar security installations are successively leased to different parties, to whom the lessor furnishes a renter's key adapted to open a given safe deposit box when the lock is partially operated or armed by a guard or prep key in the possession of the lessor. Often, lessees fail to return the renter's key at the expiration of their lease, or the lessee may lose the renter's key, and it becomes necessary in such cases to change the safe deposit key lock so that it can be operated by a renter's key bit having a different configuration. Also, even if the lessee returns the renter's key at the expiration of his lease, it is desirable to change the key bit configuration to which the lock is responsive whenever the lessee of the box is changed, to prevent the otherwise possible use of an unauthorized duplicate of the renter's key which may have been made before the renter's key was returned.

For this reason, certain safe deposit locks have been made in such a manner that the position of the gatings in the tumblers operated by the renter's key is changeable, so that the position of the gatings may be adjustably set to be opened by a different renter's key. The typical practice in this regard has been to provide a change key in the form of a non-round cross-section rod which is insertable into an opening in the safe deposit lock case or rear cover wall and through shaped openings in the renter's key tumblers, when the safe deposit lock has been activated by the old renter's key. The combination change key interfits into shaped openings in one of two pivoted companion tumbler sectors for each of the renter's key tumbler levers, all of which tumbler lever sectors are pivoted on a fixed tumbler post, to decouple the normally mated tumbler lever sections of each of these tumbler levers and permit them to be recoupled in a position corresponding to the configuration of the bit of a new renter's key.

It has become recognized that it is also desirable to provide for the setting of the guard key or prep key tumbler lever system in accordance with different guard key or prep key configurations (hereinafter generally referred to as the prep key), so that the prep key to be used with safe deposit locks can be changed from time to time to provide greater security or to reset the locks when the prep key is lost or when change of guard personnel occurs. Attempts to provide for changing the lock to accommodate different prep keys as well as different renter keys have generally involved use of renter's key tumble levers which are either made up of two pivoted companion tumbler sectors which may be selectively decoupled when the lock is in a change mode to permit relative adjustment of one of the tumbler sectors with respect to the other to accommodate the configuration of the bit of the new renter's key, and also using an entirely different set of prep key tumbler levers disposed in a portion of the lock housing spaced from the renter's key tumbler levers and a plurality of independently adjustable fence members positioned relative to the prep key tumblers capable of being set to different positions in accordance with different guard key configurations. Such a construction requires a considerably larger space consuming lock configuration and considerably increases complications and expense in the assembly of safe deposit lock units.

An object of the present invention is the provision of a novel construction of a tumbler lock for safe deposit boxes and the like, having a first group of rotatable wheel-like tumblers driven by rotatable gear sectors to be set by a prep key, and a second group of rotatable wheel-like tumblers angularly positioned by a set of gear-like sectors to be set by a renter's key, together with means operated by a change key to selectively decouple the driving gear-like sectors from the rotatable wheel-like tumblers for selective adjustment of the tumblers for a different renter's key or for a different prep key, or for both a different renter's key and a different prep key. This method of key operation is considered highly pick resistant.

Other objects, and advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
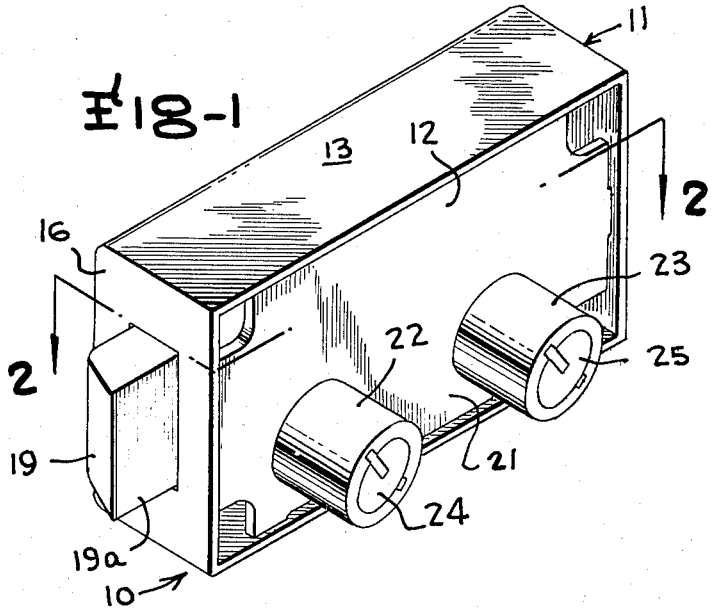
FIG. 1 is a front perspective view of a changeable safe deposit box lock embodying the present invention.
Figure 2:
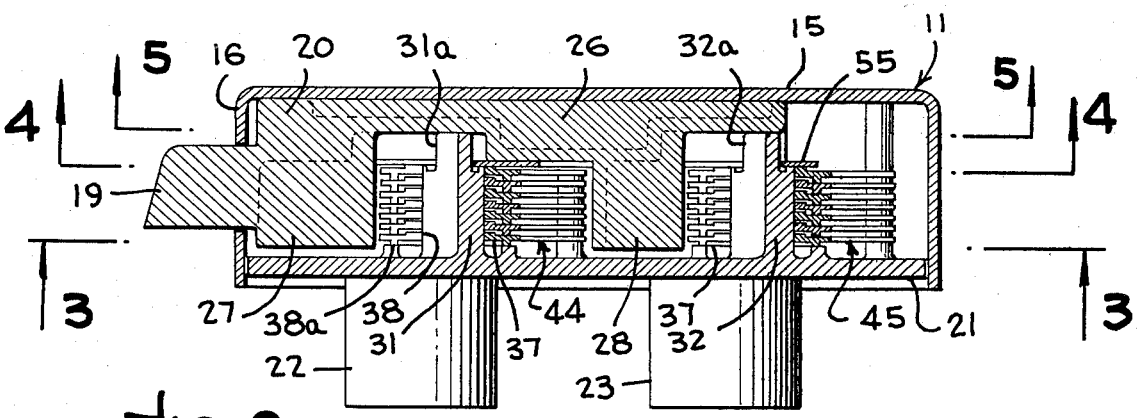
FIG. 2 is a horizontal longitudinal section view taken along the line 2—2 of FIG. 1.
Figure 6:
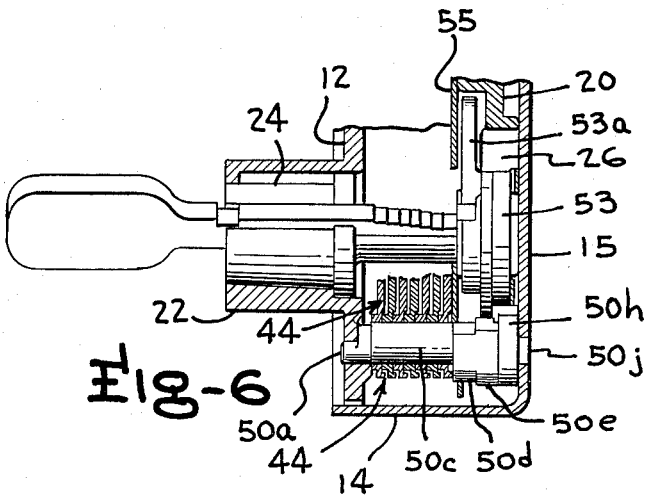
FIG. 6 is a vertical transverse section view taken along the line 6—6 of FIG. 4.

Referring to the drawings, wherein like reference characters designate corresponding parts throughout the several figures, the key operated double changeable safe deposit box lock of the present invention is indicated generally by the reference character 10, and comprises a lock case 11 and a cover plate 12 assembled by screws with the case 11 to form a box-like enclosure for the mechanism. In accordance with conventional practice, the lock case is a generally rectangular case or housing in the form of a forwardly opening box-like structure to be forwardly closed by the cover plate 12, and comprises parallel top and bottom walls 13,14, a rear wall 15, and end walls 16 and 17. The end wall 16 has an opening therethrough through which the locking bolt portion 19 integral with and extending from the bolt plate member 20 projects. The front cover plate 12 includes a front panel or wall 21 having tapped posts or formations for screws for assembling the cover plate to the case. The cover plate 12 has a pair of forwardly projecting horns or annular bosses 22,23, one of which serves as the horn for the renter's key, and the other of which serves as the horn for the guard or prep key. In the illustrated embodiment, the horn 22 is the renter's key horn and the horn 23 is the prep key horn. These horns 22 and 23 serve as outwardly surrounding tubular bearings for the hubs or plugs, indicated at 24 and 25, for the renter's key and guard or prep key respectively, and extend through the customary circular openings provided therefor in the door of the conventional safe deposit box compartment or chamber. The corners of the lock case 11 are provided with the customary holes, as shown, extending therethrough for fastening bolts projecting into tapped openings in the conventional safe deposit compartment door to mount the assembled case and cover plate against the inner surface of the door.

The bolt plate member 20 includes the usual heavy bolt portion 19 in the form of a thick rectangular block which projects from the lock case 11 through the wall 16 thereof into a conventional keeper recess, within the locking or projected position, and includes an integral bolt plate portion 26 shaped as illustrated to provide a pair of relatively thin rectilinear or straight planiform rib-like fence members 27 and 28 to coact with two packs of gated tumber wheels for the renter's key and prep key respectively, as later described, and having a pair of elongated socket or slot formations 29,30 facing forwardly to receive reduced diameter cylindrical end portions **31*a*,32*a* of cylindrical journal posts or spindles 31,32 for the two packs of gated tumbler wheels, and being guided by the reduced end portions of these journal posts for rectilinear reciprocative movement of the bolt plate member and bolt between its projected and retracted positions. It will be noted that the journal posts or spindles 31,32 for the gated tumbler wheels project integrally rearwardly from the front cover plate 12 which, in the assembled position of the lock is securely fastened to the case 11, and extends rearwardly to a position whereby its reduced diameter end portions are accommodated in the elongated slots 29,30 of the bolt plate portion 26 permitting relative sliding movement of the bolt through its reciprocative path, and the bolt plate portion 26 also includes relieved or opening portions 26*a* and 26*b*** to receive portions of the key operated mechanisms for the renter's key and prep key as later described.

The gated tumbler wheels, indicated by the reference character 34, are arranged in two tumbler wheel stacks 35,36, to be driven in accordance with the shape of the renter's key and of the guard or prep key, respectively, and each are formed of a relatively thin generally disc-like cylinder or body portion 37 having a circular center opening 38 whose diameter corresponds substantially to the diameters of the journal posts or spindles 31,32. The cylindrical or body portions of the gated tumbler wheels 34 also have an interrupted annular rib **38*a* projecting from one face thereof to slidably bear against the opposite face of the adjacent gated tumbler wheel to maintain proper spacings between them in the stacks 35,36. The fence receiving gate or recess for each gated tumbler wheel 34 is indicated at 39, and in the illustrated embodiment, includes an outwardly flaring or diverging entrance portion 39*a* adjacent the periphery of the gated tumbler wheel 34 and a narrower throat portion 39*b* of sufficient width to accommodate the fence members 27 or 28 extending from the diverging entrance portion to the center opening 38. An additional gate portion indicated at 39*c* extend outwardly from part of the center opening 38 opposite the throat 39*b* in diametric alignment with the center line of the gate portions 39*a*,39*b* to accommodate sufficient movement of the fence members 27,28** for complete retraction of the bolt.

A substantial circumferential portion of the periphery of each gated tumbler wheel, for example about 95° to 100° along the circumference, is provided with gear teeth as indicated at 40, and are normally coupled with the gear teeth 42 on the angularly adjustable sector-shaped tumbler levers 43 forming drive sector levers arranged in two stacks 44,45 adjacent the keyways of the block to be engaged and angularly positioned by the blade or bit portion of either the renter's key or the guard or prep key. The sector levers 43 have generally fan-shaped body portions 46 provided with convex key engaging surfaces 47 along a side edge of the fan-shaped body portion 46 and include, in the illustrated embodiment, an integral spring forming extension 48 projecting as a recurved tail-like extension from a corner of the curved toothed edge of each sector lever to bear against a stationary post 49 projecting from the front cover and bias the sector levers 43 in a counterclockwise direction about the eccentric pivot member 50 on which the lower end portions of the sector levers 43 are journaled. Arcuate members 51 are also formed integrally on and extend from the cover plate 12 and are located radially close to but outwardly of the curved tooth-bearing edge **42*a*** of each of the packs of sector levers.

The eccentric pivot members 50 for the two stacks 44 and 45 of the sector levers 43 are especially designed to move the stacks of sector levers 44,45 toward and away from the gated tumbler wheels 35,36 to engage and disengage their associated gear sections, upon rotation of the eccentric pivot members 50 through a selective angular range, for example of about 90°, by means of a specially shaped change key inserted through associated openings **50*j* in the rear wall 15 of the case 10 when the safe deposit box door carrying the lock has been opened to expose the lock mounted on the inner surface of the wall. The pivot member 50, as illustrated in the drawings, includes a forwardmost end portion 50*a* of cylindrical configuration concentric with the axis of rotation, indicated at 50*f*, for the pivot member 50, extending into a socket in the front cover plate 12 forming a journal bearing for the pivot member, and includes a tongue portion 50*b* immediately rearwardly of the cylindrical front end portion 50*a* and an eccentric cylindrical section 50*c* concentric with the eccentric axis 50*g* offset from the axis 50*f*. The member 50 also includes an interrupted cylindrical bearing section 50*d* and an adjoining interrupted cylindrical section 50*e*, both concentric with the main rotation axis 50*f* and an end section having radially projecting tongue 50*h* and a rearwardly facing change key socket 50*i* which is exposed through the change key opening 50*j* associated with the eccentric pivot member 50 in the rear case wall 15. The front cover member 12 has a boss formation 52 provided with a 90° recess into which the tongue portion 50*b* of the pivot member 50** projects to limit rotation of the pivot member to 90°.

A prep key cam 53 and a guard key cam 54 are journaled on the shanks 24*a*,25*a* of the plugs 24,25 to be rotated by the keys inserted therein. The eccentric cylindrical midportion 50*c* of each pivot member forms the pivot for the associated stack 45 or 46 of the tumbler sector levers 44 for the prep or guard key and for the renter's key, so that upon rotation of the associated pivot member 50 from its normal position, viewed in FIG. 3, to its change position, the eccentric midportion 50*c* of the pivot member causes the stack of tumbler sector levers 44 pivotally mounted thereon to be retracted downwardly and to the right as viewed in FIG. 4 to disengage the gear teeth 42 of the associated sector levers from the gear teeth 40 of the gated tumbler wheels 34. The interrupted cylindrical portions 50*d* and 50*e* and the tongue portions 50*h* of the pivot members 50 coact with shaped surfaces of the prep key cam 53 and renter's key cam 54 to selectively hold the eccentric pivot members 50 in tumbler engaging positions or tumbler disengaging positions and to restrict or enable rotation of the prep key or change key as later described herein.

There is also present in the assembly a deck plate member 55 which fits over the shank portions 25*a*,24*a* of the guard key plug 25 and renter's key plug 24*a* rearwardly of the stack of sector levers 44 and 45 between the two stacks of sector levers 44,45 and gated tumbler wheels of stacks 35 and 36 associated therewith and the renter's key cam 54 and prep key cam 53 respectively. This deck plate member 55 also includes approximately 90° key bit openings 56*a* and 56*b* to limit the range of rotation of the keys inserted in the renter key plug and prep key plug 24 and 25, and also includes circular recesses 57*a* and 57*b* for the pivot members 50.

It will be appreciated that the various components such as the stacks 44,45 of sector levers 43 and the stacks 35,36 of the gated tumbler wheels 34, together with the deck plate member 55 which controls the center distance of the mechanism and the bolt plate member 20, may be readily assembled onto the appropriate posts projecting integrally from the cover plate member 12 and spring washers fitted about the posts 31,32 and against the prep cam and renter cam 53,54 and this subassembly with the pivot members 50 assembled therewith inserted into the case 11 and assembled by means of the mounting screws to form the assembled changeable safe deposit lock package.

By the hereinabove described construction, either one or both of the keys, namely either the guard or prep key or the renter's key, may be changed as desired, and the arrangement is such that the renter key must be used after prep key operation to unlock the box. The prep key must remain in the safe deposit lock until the lock has been retracted to unlocked or lockout condition, but the prep key may be removed after such lockout or unlocked condition and is not required for relocking the box. The renter key is required whenever it is desired to relock the box.

To change either the renter key or the guard or prep key, the safe deposit box must be open, as the access openings for the change key are only in the rear wall 15 of the case 10 which is only exposed to access when the safe deposit box is open.

For normal operation of the safe deposite box lock, the prep key, indicated at 60, is inserted into the key way in the prep key plug 25, and turned clockwise, as viewed in FIG. 1 to the positive stop position. This brings the key bit to the position illustrated in FIG. 3 engaging its contoured edge with the key engaging edge portion 47 of the sector levers 43 for the prep key stack 45, and rotates the respective tumbler levers 43 of this stack 45 through appropriate angular positions about the pivot 50 to rotate the intercoupled gated tumbler wheels 34 of the stack 36 to the position illustrated in FIG. 3 aligning their gates 39 with the fence 28 of the bolt plate 20 to receive the bolt plate fence 28, when the renter key of appropriate configuration is inserted and rotated.

Figure 3:
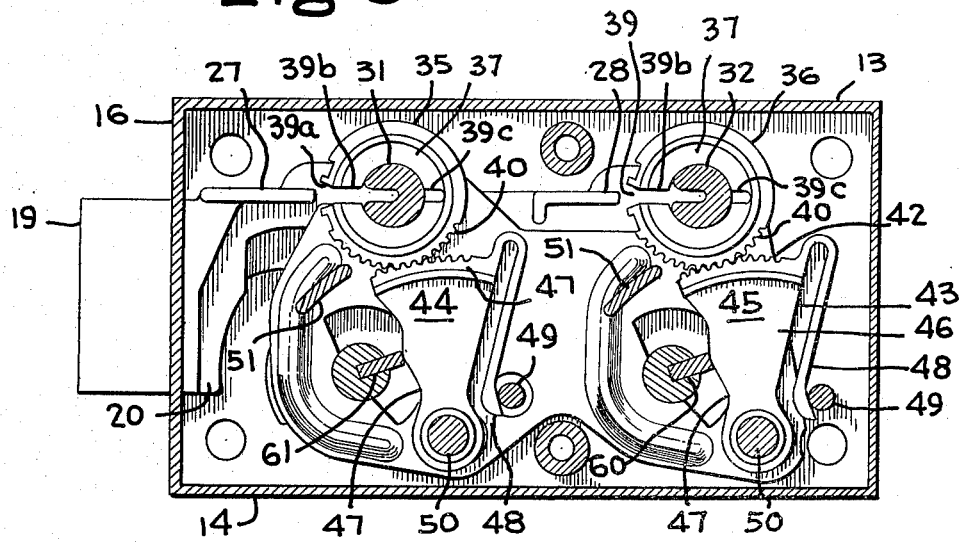
FIG. 3 is a vertical longitudinal section view taken along the line 3—3 of FIG. 2, showing the stack of key operated sector levers and associated gate wheels positioned by proper keys for retraction of the bolt, but with the bolt in extended position.
Figure 4:
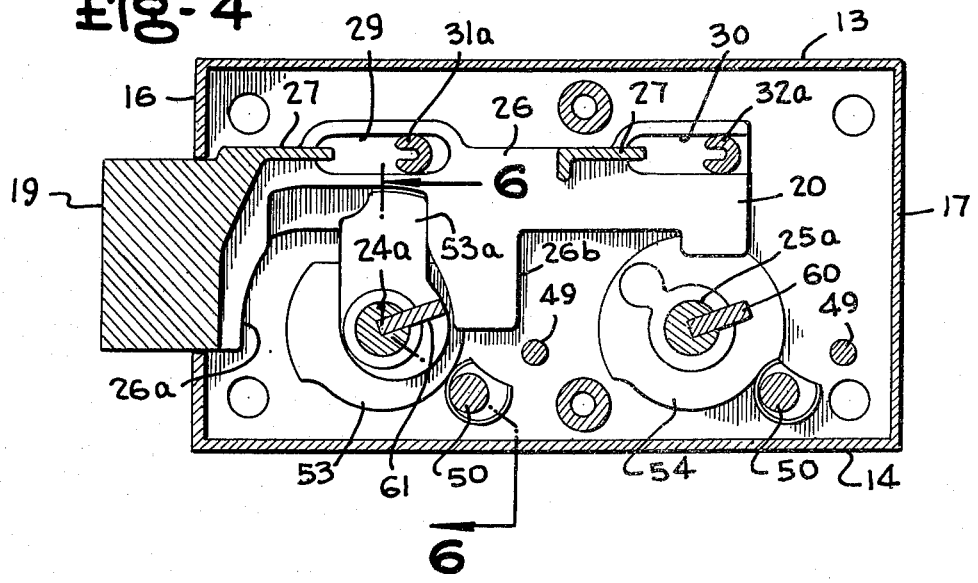
FIG. 4 is a vertical longitudinal section view taken along the line 4—4 of FIG. 2, showing the eccentric mechanism.
Figure 5:
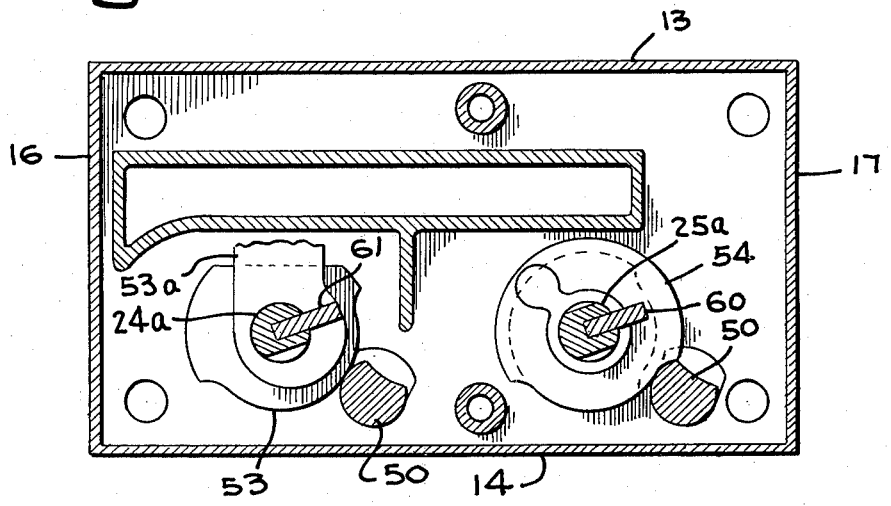
FIG. 5 is a vertical longitudinal section view taken along the line 5—5 of FIG. 2, showning the bolt in extended position rearwardly of the eccentric mechanism.
Figure 7:
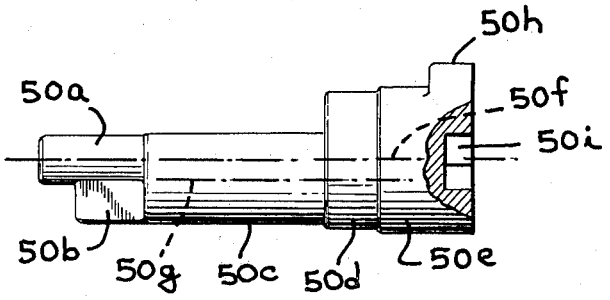
FIG. 7 is an elevation view of the eccentric pivot member which supports each stack of sector levers.
Figure 8:
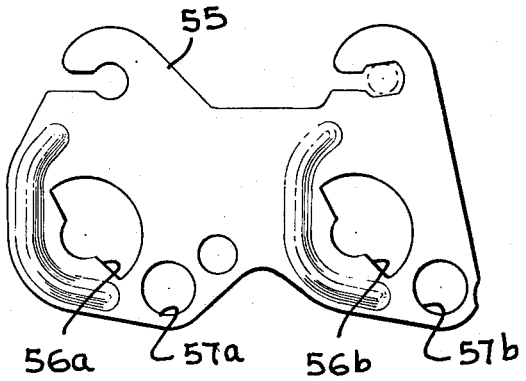
FIG. 8 is an elevation view of the deck plate.

The renter key 61 is then inserted into the renter key plug 24 and rotated clockwise to the positive stop position, disposing the renter key bit for the key 61 at the position shown in FIGS. 3–5 where the shaped edges of the key bit engaged the key follower edge portions 47 of the sector levers 43 in the renter key stack 44, rotating these tumbler levers 44 through appropriate angles to rotate the associated gated tumbler wheels 34 of the stack 35 having gear tooth intercoupling with the stack 44 of the sector levers to the position shown in FIG. 3 disposing their gates 39 in position to receive the associated fence 27 on the bolt plate member 20. At the angular position where the renter's key bit engages the higher portions 47 of the key follower edge of the renter's key lever stack 44, the finger or tongue formation 53*a* on the renter's key cam 53 enters the recess 26*a* of the bolt plate member 20 and reaches the position shown in FIG. 4, whereupon further rotation of the renter's key to the positive stop position interengages the renter's key cam finger 53*a* with surfaces of the bolt plate member to retract the bolt plate member to fully retracted or unlocked position. The prep key is thus turned counterclockwise to the stop position and removed after the renter's key has been inserted and turned clockwise to retract the bolt. In this condition, the change key slots or openings 51*j* are exposed, but the prep change key is locked out and only the renter key is exposed to change. Upon closing of the safe deposit box door, the renter key is turned counterclockwise, with reference to FIG. 1, whereby the movement of the finger portion 53*a* on the renter cam 53 engages surfaces of the bolt plate number 20 to shift the bolt toward projected position, causing the fence 27 and 28 to leave the gates of the gated tumbler wheels 35,36 and the gates then become scrambled.

For changing the prep key or guard key, the prey key is first inserted and turned counterclockwise to the stop position, as previously described, the renter's key 61 is then inserted into its plug 24 and turned counterclockwise to the stop position, again as previously described, which retracts the bolt 19, and the safe deposit box door is opened. The change key slots for both the renter's key and the guard or prey key are now exposed. The prep change key is then inserted into the slot 50*i* in the appropriate pivot member 50 and is rotated clockwise to the stop position. The movement of the eccentric midportion 50*c* of the pivot member 50 by the prep change key disengages the stack 45 of prep key sector levers from the associated stack 36 of gated tumbler wheels 34 and the eccentric position of the pivot 50 for the prep change key locks the prep cam 54 against rotation. The prep key clockwise stop is thus released, and the prep key presently in the lock is moved to the new stop position aligned with the slot 23*b* in the prep key horn 23, and the old prep key is removed. The prep sector levers of the stack 45 return to neutral position, while the prep fence 28 positioned in the gates of the gated tumbler wheels 36 control the tumbler wheels of the stack 36. The eccentric portion of the pivot 50 for the prep lever stack is locked out preventing reuniting of the levers with their elongated tumbler wheels in the neutral position.

The new prep key is then inserted and turned counterclockwise to the resistance stop position wherein its surfaces engage the follower edge portion 47 of the sector levers of the stack 45, whereby the levers 45 become arranged in positions to agree with the new key, and the eccentric lockout for the prep key section is released. Rotation of the prep change key counterclockwise to its positive stop then reunites the stack 45 of prep key sector levers with their associated gated tumbler wheels 34 of the stack 36, in accordance with the new combination, the counterclockwise prep key stop is released, the clockwise prep key stop becomes again active, and the prep key is rotated counterclockwise to the positive stop position. The bolt plate member lock is thus released when the prep key cam is rotated to this counterclockwise positive stop position, and the renter key may then be rotated clockwise to its positive stop position causing both fences 27 and 28 to leave the gates of the gated tumbler wheels. Preferably, this is done while the door is still in open position to permit testing of the new prep key, before the door is closed, to be sure the lock has been properly set to operate with the new prep key.

For change of the renter key, the prep key 60 is inserted in its appropriate plug 25 and turned clockwise to the stop position, the renter key 61 is inserted in its plug 24 and turned clockwise to the stopped position, the prep key 60 is then turned counterclockwise to the stop position and the safe deposite box door opened exposing the change key slots. In this condition, the prep change key operation is locked. The renter change key is then inserted into the key bit opening 51*i* of the pivot member 50 associated with the stack 44 of renter key sector levers and the pivot member 50 associated therewith is rotated clockwise to the stop position, causing the eccentric midportion 51*c* of this pivot member 50 to disengage the renter sector levers 44 from the associated gated tumbler wheels 36, the fences 27 and 28 are locked in preventing loss of the gates as the renter eccentric position of the associated pivot member 50 locks the renter key against reverse rotation, and the renter key is now allowed to be rotated to the new stop position and removed, causing the sector levers 44 associated with the renter key to return to neutral. The eccentric portion of the pivot member 50 associated with the renter key is locked out preventing reuniting of the renter sector levers 44 in neutral position. The new renter key is inserted in the lug 24 and turned counterclockwise to the stop position as viewed in FIG. 1, causing the sector levers 44 to be arranged in positions to agree with the new key and release the renter eccentric lockout. The renter change key is then rotated counterclockwise to the stop position and removed, causing the renter sector levers 44 to reunit with their associated tumbler wheels 35, in accordance with the new combinations, the counterclockwise renter key stop is removed, and the clockwise renter key stop is rendered active. The renter key is then rotated counterclockwise to the stop position and removed, returning the bolt projected position causing the fences 27 and 28 to leave the gates of the gates tumbler wheels 35,36 and the bolt is thus locked in the projected position. Again, this should be first done with the safe deposit box door in open position to test the new renter to be sure that the lock is now set for the new key configuration.

I claim:

1. A changeable multiple key lock for safe deposit boxes and the like, comprising a lock case, a locking bolt including an integral bolt plate slidably movable in said case between projected locking and retracted unlocking positions and having a pair of longitudinally spaced fence members projecting therefrom, first and second stacks of peripherally gated tumbler wheels rotatably supported about respective parallel center axes in the path of longitudinal unlocking movement of said fence members to bar retraction of said fence members from the projected locking position, the tumbler wheels having gating recesses for accommodating said fence members to accommodate retraction of said bolt to unlocking position, first and second sets of key operable sector levers pivotally mounted on respective pivot posts and having gear teeth couplings respectively with the two stacks of tumbler wheels and having key follower surfaces to be engaged by portions of a guard key and renter key inserted into the lock and rotated to unlocking position to drive the associated tumbler wheels to unlocking position, and said pivot posts for said first and second sets of sector levers having means mounting them eccentrically in the lock case and having change key receiving openings therein for rotation of said posts pivot to positions withdrawing the first and second sets of sector levers to decoupled positions relative to their associated tumbler wheels by a change key to free the sector levers to assume new positions corresponding to a new renter's key or a new guard key introduced and positioned to set the sector levers and their associated tumbler wheels while they are decoupled from each other.

2. A changeable multiple key lock for safe deposit boxes, as defined in claim 1, wherein said sector levers are fan-shaped members having a convex arcuate edge portion provided with said gear teeth along said edge intercoupled with the tumbler wheels to rotate the same upon angular movement of the sector levers by the shaped surfaces of the associated renter or guard key.

3. A changeable multiple key lock for safe deposit boxes, as defined in claim 1, wherein said sector levers are fan-shaped members having a convex arcuate edge portion provided with said gear teeth along said edge intercoupled with the tumbler wheels to rotate the same upon angular movement of the sector levers by the shaped surfaces of the associated renter or guard key and having a unitary integral key engaging convex edge portion and a unitary integral thin resiliently deformable elongated leg extending along the length of the edge opposite the convex edge portion and bearing against a stop post to resiliently bias the associated sector lever to a position disposing the gate of the associated tumbler wheel out of fence receiving position.

4. A changeable multiple key lock for safe deposit boxes as defined in claim 2, wherein said stacks of tumbler wheels are rotatably journaled for rotation about the center axes of a pair of integral unitary cylindrical axle posts therefor extending from said lock case at longitudinally spaced positions thereon and said tumbler wheels having a center hole sized to receive one of said axle posts and journal the tumbler wheel thereon and a radial slot extending from the wheel periphery to said center hole to receive the associate fence member and accommodate movement thereof to unlocking position.

5. A changeable multiple key lock for safe deposit boxes as defined in claim 3, wherein said stacks of tumbler wheels are rotatably journaled for rotation about the center axes of a pair of integral unitary cylindrical axle posts therefor extending from said lock case at longitudinally spaced positions thereon and said tumbler wheels having a center hole sized to receive one of said axle posts and journal the tumbler wheel thereon and a radial slot extending from the wheel periphery to said center hole to receive the associate fence member and accommodate movement thereof to unlocking position.

6. A changeable multiple key lock for safe deposit boxes as defined in claim 2, wherein said stacks of tumbler wheels are rotatably journaled for rotation about the center axes of a pair of integral unitary cylindrical axle posts therefor extending from said case through slots in said bolt plate at longitudinally spaced positions thereon and and having a radial slot therein facing the fence members to receive the later therein at the unlocking position of the bolt and said tumbler wheels having a center hole sized to receive one of said axle posts and journal the tumbler wheel thereon and a radial slot extending from the wheel periphery to said center hole to receive the associate fence member and accommodate movement thereof to unlocking position when the radial slots of the wheels and posts are in registration.

7. A changeable multiple key lock for safe deposit boxes as defined in claim 3, wherein said stacks of tumblers wheels are rotatably journaled for rotation about the center axes of a pair of integral unitary cylindrical axle posts therefor extending from said case through slots in said bolt plate at longitudinally spaced positions thereon and and having a radial slot therein facing the fence members to receive the latter therein at the unlocking position of the bolt and said tumbler wheels having a center hole sized to receive one of said axle posts and journal the tumbler wheel thereon and a radial slot extending from the wheel periphery to said center hole to receive the associate fence member and accommodate movement thereof to unlocking position when the radial slots of the wheels and posts are in registration.

8. A changeable multiple key lock for safe deposit boxes as defined in claim 1, including a pair of cam members supported in the case for rotating about the axis of rotation of the guard and renter keys respectively having a finger portion shaped to shift the bolt plate to unlocking position when the tumbler wheels. are alined to receive the fence members and having shaped peripheral recesses coactive with portions of said pivot posts to restrict the range of positions attainable by the renter and guard keys when the lock is in normal and change modes.

9. A changeable multiple key lock for safe deposit boxes as defined in claim 2, including a pair of cam members supported in the case for rotating about the axis of rotation of the guard and renter keys respectively having a finger portion shaped to shift the bolt plate to unlocking position when the tumbler wheels are alined to receive the fence members and having shaped peripheral recesses coactive with portions of said pivot posts to restrict the range of positions attainable by the renter and guard keys when the lock is in normal and change modes.

10. A changeable multiple key lock for safe deposit boxes as defined in claim 4, including a pair of cam members supported in the case for rotating about the axis of rotation of the guard and renter keys respectively having a finger portion shaped to shift the bolt plate to unlocking position when the tumbler wheels are alined to receive the fence members and having shaped peripheral recesses coactive with portions of said pivot posts to restrict the range of positions attainable by the renter and guard keys when the lock is in normal and change modes.

11. A changeable multiple key lock for safe deposit boxes as defined in claim 6, including a pair of cam members supported in the case for rotating about the axis of rotation of the guard and renter keys respectively having a finger portion shaped to shift the bolt plate to unlocking position when the tumbler wheels are alined to receive the fence members and having shaped peripheral recesses coactive with portions of said pivot posts to restrict the range of positions attainable by the renter and guard keys when the lock is in normal and change modes.

12. A changeable multiple key lock for safe deposit boxes as defined in claim 7, including a pair of cam members supported in the case for rotating about the axis of rotation of the guard and renter keys respectively having a finger portion shaped to shift the bolt plate to unlocking position when the tumbler wheels are alined to receive the fence members and having shaped peripheral recesses coactive with portions of said pivot posts to restrict the range of positions attainable by the renter and guard keys when the lock is in normal and change modes.

* * * * *